US006566608B2

(12) United States Patent
Yamaguchi et al.

(10) Patent No.: US 6,566,608 B2
(45) Date of Patent: May 20, 2003

(54) PRODUCTION METHOD OF ANISOTROPIC CONDUCTIVE FILM AND ANISOTROPIC CONDUCTIVE FILM PRODUCED BY THIS METHOD

(75) Inventors: Miho Yamaguchi, Ibaraki (JP); Ichiro Suehiro, Ibaraki (JP); Fumiteru Asai, Ibaraki (JP); Yuji Hotta, Ibaraki (JP)

(73) Assignee: Nitto Denko Corporation, Ibaraki (JP)

( * ) Notice: Subject to any disclaimer, the term of this patent is extended or adjusted under 35 U.S.C. 154(b) by 0 days.

(21) Appl. No.: 09/837,411

(22) Filed: Apr. 18, 2001

(65) Prior Publication Data

US 2001/0032733 A1 Oct. 25, 2001

(30) Foreign Application Priority Data

Apr. 18, 2000 (JP) ..... 2000-117039

(51) Int. Cl.[7] ..... H01B 7/00; H01B 7/34

(52) U.S. Cl. ..... 174/117 F; 174/117 FF; 174/36

(58) Field of Search ..... 174/36, 110 R, 174/117 F, 117 FF, 113 R

(56) References Cited

U.S. PATENT DOCUMENTS

| | | | | | |
|---|---|---|---|---|---|
| 2,998,840 | A | * | 9/1961 | Davis | 154/2.6 |
| 3,438,843 | A | * | 4/1969 | Pagel | 161/143 |
| 3,852,878 | A | | 12/1974 | Munro | |
| 4,218,581 | A | * | 8/1980 | Suzuki | 174/117 F |
| 5,262,226 | A | * | 11/1993 | Yoshida | 428/209 |
| 5,552,565 | A | * | 9/1996 | Cartier et al. | 174/117 F |
| 5,628,852 | A | * | 5/1997 | Ishida | 156/182 |
| 5,652,055 | A | * | 7/1997 | King et al. | 428/343 |
| 5,681,647 | A | * | 10/1997 | Caillat | 428/209 |
| 5,879,530 | A | * | 3/1999 | Caillat | 205/122 |
| 5,967,804 | A | * | 10/1999 | Yoshizawa et al. | 439/91 |
| 6,133,637 | A | * | 10/2000 | Hikita et al. | 257/777 |
| 6,245,175 | B1 | * | 6/2001 | Hotta et al. | 156/172 |

FOREIGN PATENT DOCUMENTS

| | | | | |
|---|---|---|---|---|
| EP | 0232127 | * | 8/1987 | H01R/23/68 |
| EP | 0 469 798 | | 2/1992 | |
| JP | 10 022033 | | 1/1998 | |
| JP | 10 022034 | | 1/1998 | |
| WO | WO 98/07216 A | * | 2/1998 | H01R/43/00 |

* cited by examiner

*Primary Examiner*—Dean A. Reichard
*Assistant Examiner*—William H. Mayo, III
(74) *Attorney, Agent, or Firm*—Leydig, Voit & Mayer, Ltd.

(57) ABSTRACT

The present invention provides a production method of an anisotropic conductive film, which method includes the steps of (a) winding an insulated wire around a core member to form one roll of a winding layer, this insulated wire including a metal conductor wire and a coating layer made from an insulating resin, this coating layer being formed on the wire, placing an insulating resin film on the obtained winding layer, and repeating the winding and the placing to give a laminate alternately having the winding layer having a single row of insulated wires and an insulating resin layer made from the insulating resin film, (b) partially or entirely melting at least one of the coating layer and the insulating resin layer to integrate the winding layer and the insulating resin layer, and (c) slicing the laminate along a plane forming an angle with the insulated wire in a desired film thickness.

5 Claims, 9 Drawing Sheets longitudinal direction of core member

PRODUCTION METHOD OF ANISOTROPIC CONDUCTIVE FILM AND ANISOTROPIC CONDUCTIVE FILM PRODUCED BY THIS METHOD

TECHNICAL FIELD OF THE INVENTION

The present invention relates to a production method of an anisotropic conductive film and an anisotropic conductive film produced by this method.

BACKGROUND OF THE INVENTION

Anisotropic conductive films have been widely used in the electronic industry as a connector for testing semiconductor devices and circuit boards, a connector of circuits between boards, a material for mounting a semiconductor device on a circuit board and the like. A known anisotropic conductive film is formed by dispersing conductive particles in a film made from an adhesive insulating resin. However, this anisotropic conductive film is subject to restriction because a fine pitch connection is difficult to achieve and a convex terminal (e.g., bump contact) is required as a connection terminal of a semiconductor element.

To solve this problem, the Applicant proposed, in WO98/07216 etc., an anisotropic conductive film having plural conductive paths insulated from each other and penetrating an insulating film substrate in the thickness direction of the film substrate. The proposed anisotropic conductive film contains plural conductive paths with both ends exposed on the surface of the film substrate made from an insulating resin, and, of these plural conductive paths, those located at the positions allowing contact with the termini of an object to be electrically conducted afford electrical continuity with this object.

However, a close study of the physical properties and the connection state of the connection mate of the anisotropic conductive film proposed above has revealed that the conductive path (metal conductor) in the film has a density higher than necessary, making the film hard to deform, which in turn tends to lower the follow-up property of the film to the connection target (particularly in the case of testing connectors, the degraded follow-up property of the film to the test target sometimes necessitates hard pressing of the film with a high pressure to bring a conductive path in contact with a terminal (electrode) of the test target), and that the density of the conductive path (metal conductor), which is higher than necessary, makes the amount of the insulating resin insufficient to provide an adhesive property when used as a material for mounting, thereby preventing sufficiently high adhesion to an object to be connected.

The above-mentioned conventional anisotropic conductive film is produced by winding plural insulated wires (metal conductor wires having a coating layer made from an insulating resin) around a core member to give a multi-layer roll with the insulated wires densely packed both in the longitudinal direction and the transverse direction, adhering coating layers to make the densely packed insulated wires inseparable, and slicing each insulated wire along the plane forming an angle with the wire section to give a film having a conductive path made of the metal conductor wires. By making thicker the coating layer of the insulated wire to be wound around the core member, the interval of the metal conductor wires (conductive paths) can be widened, which in turn lowers the density of the conductive paths in the film to some degree. While the coating layer can be made thick by repeat coating the metal conductor wires with an insulating resin, the cost necessary for this step is not small at all and the step is impractical. In addition, it is not that the thickness of the coating layer can be increased to any desired level, and the interval of the metal conductor wires (conductive paths) cannot be widened sufficiently. On the other hand, a comparatively large clearance may be formed between adjacent insulated wires when bundling the plural insulated wires and the coating layer of the insulated wires may be melted to widen the interval of the metal conductors. In this case, however, unnecessary voids are formed between the metal conductor wires in the film, thus lowering the strength of the film to the extent that it is not practicable.

SUMMARY OF THE INVENTION

It is therefore an object of the present invention to provide a production method of an anisotropic conductive film, which is capable of sufficiently widening the interval (pitch) of the centers of conductive paths without forming unnecessary voids in the film.

It is also an object of the present invention to provide an anisotropic conductive film, which has a sufficient strength and deformability, which shows fine follow-up property to an object to be connected, which is capable of connecting a conductive path to a terminal (electrode) of a test object with a low pressure, when used for testing connectors, and which can form a highly reliable electrical connection by firmly adhering to an object to be connected, when used as a mounting material.

It has been also found that an anisotropic conductive film free of unnecessary voids in the film, having a sufficiently large pitch of conductive paths (metal conductors), and having a decreased density of the conductive paths can be obtained by forming a laminate comprising alternate layers of a winding layer comprising a single row of insulated wires, and an insulating resin film, which laminate being made by placing an insulating resin film on the winding layer comprising the insulated wire wound around a core member, and cutting this laminate to give a film.

Accordingly, the present invention provides the following.

(1) A production method of an anisotropic conductive film, which method comprises the steps of
  (a) winding an insulated wire around a core member to form one roll of a winding layer, said insulated wire comprising a metal conductor wire and a coating layer made from an insulating resin, which coating layer being formed on said wire, placing an insulating resin film on the obtained winding layer, and repeating the winding and the placing to give a laminate alternately having the winding layer comprising a single row of insulated wires and an insulating resin layer made from the insulating resin film,
  (b) partially or entirely melting at least one of the coating layer and the insulating resin layer to integrate the winding layer and the insulating resin layer, and
  (c) slicing the laminate along a plane forming an angle with the insulated wire in a desired film thickness.

(2) The production method of the anisotropic conductive film of the above-mentioned (1), wherein the insulated wire is wound around the core member in such a manner that a space is formed between one winding and the next winding of the insulated wire.

(3) The production method of the anisotropic conductive film of the above-mentioned (1) or (2), wherein a winding position of the insulated wire in odd-numbered winding layers and a winding position of that in even-numbered winding layers, as counted from the core member, are different from each other in the longitudinal direction of the core member.

(4) The production method of the anisotropic conductive film of the above-mentioned (1), wherein the coating layer of the insulated wire and the insulating resin film are made from the same kind of resin.

(5) The production method of the anisotropic conductive film of the above-mentioned (1), wherein the insulating resin film has a multilayer structure.

(6) The production method of the anisotropic conductive film of the above-mentioned (5), wherein the insulating resin film comprises at least one surface layer, which comes into contact with the coating layer of the insulated wire, and which softens and flows to be able to adhere to the coating layer of the insulated wire at a temperature at which the layers other than the surface layer do not soften.

(7) The production method of the anisotropic conductive film of the above-mentioned (5), wherein the film having the multilayer structure comprises at least one surface layer, which comes into contact with the coating layer of the insulated wire, and which has a softening point lower by 20° C. or more than the softening point of the layers other than the surface layer.

(8) An anisotropic conductive film produced by the production method of the above-mentioned (1), which comprises a band area A comprising a first insulating resin layer and plural conductive paths, the conductive paths being insulated from each other, arranged in one row and penetrating the first insulating resin layer in a layer thickness direction, and a band area B comprising a second insulating resin layer without a conductive path, wherein the band areas A and the band areas B are alternately melt-adhered to form the film.

(9) The anisotropic conductive film of the above-mentioned (8), wherein the plural band areas A each comprise a row of conductive paths, the rows of the conductive paths being arranged in parallel, and two band areas A sandwiching one band area B are disposed at a distance of 2.5–10 times the diameter of the conductive path as measured between the centers of the conductive paths of two band areas A.

(10) The anisotropic conductive film of the above-mentioned (8), wherein the first insulating resin layer of the band area A and the second insulating resin layer of the band area B are made from the same kind of resin.

(11) The anisotropic conductive film of the above-mentioned (8), wherein the second insulating resin layer of the band area B has a multilayer structure comprising plural layers laminated in the width direction thereof, and at least one layer on the side that comes into contact with the first insulating resin layer of the band area A softens and flows to be able to adhere to the first insulating resin layer at a temperature at which the layers other than this layer do not soften.

(12) The anisotropic conductive film of the above-mentioned (11), wherein, of the plural layers constituting the second insulating resin layer of the band area B, at least one layer on the side that comes into contact with the first insulating resin layer has a softening point lower by 20° C. or more than that of the layers other than the surface layer.

(13) The anisotropic conductive film of the above-mentioned (8), wherein the film contains a conductive path in a proportion of volume of 1–30%.

DETAILED DESCRIPTION OF THE INVENTION

In the following, the present invention is explained in detail be referring to the Figures.

Figure 1A:
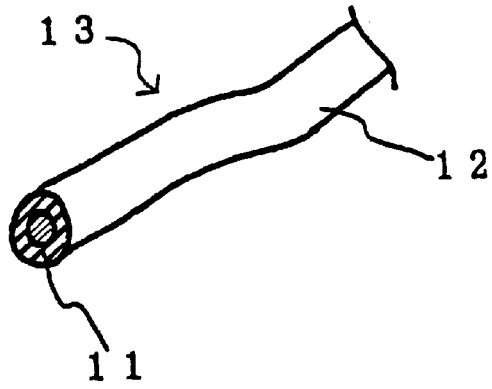
FIG. 1 shows a laminating process of a winding layer of insulated wires and an insulating resin film in the production of the anisotropic conductive film of the present invention.
Figure 1B:
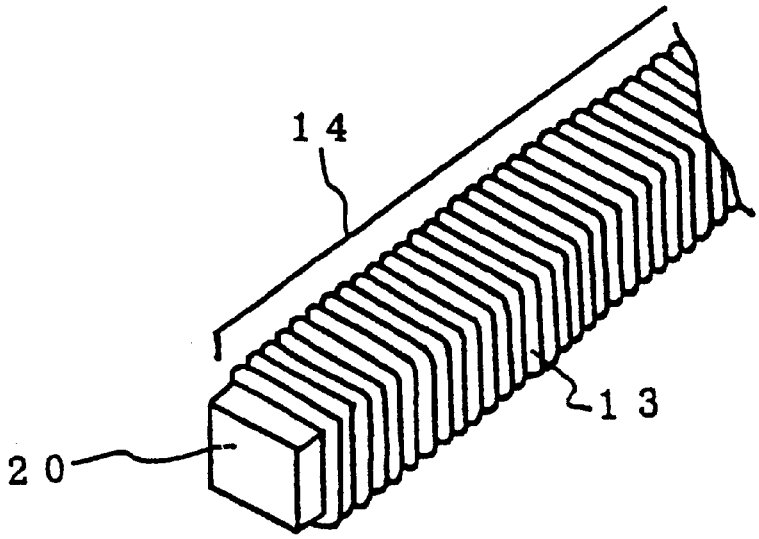
Figure 1C:
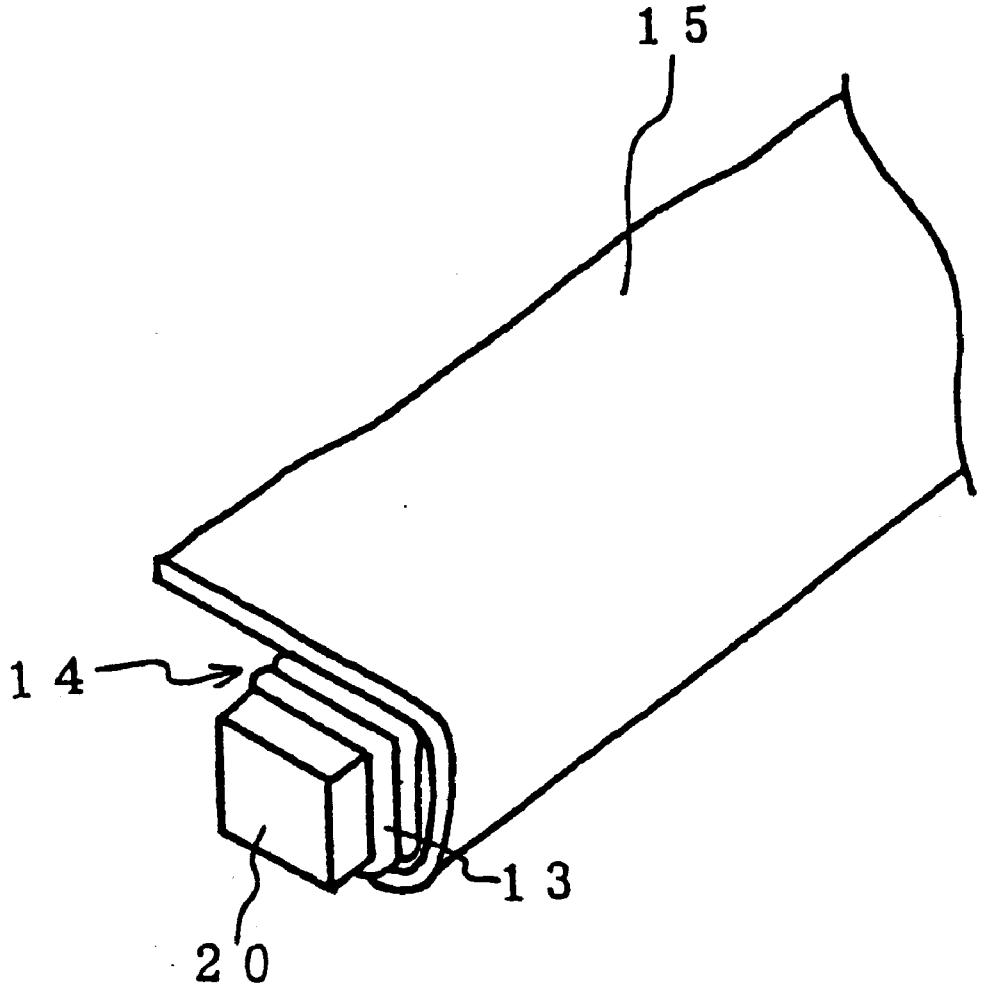
Figure 2A:
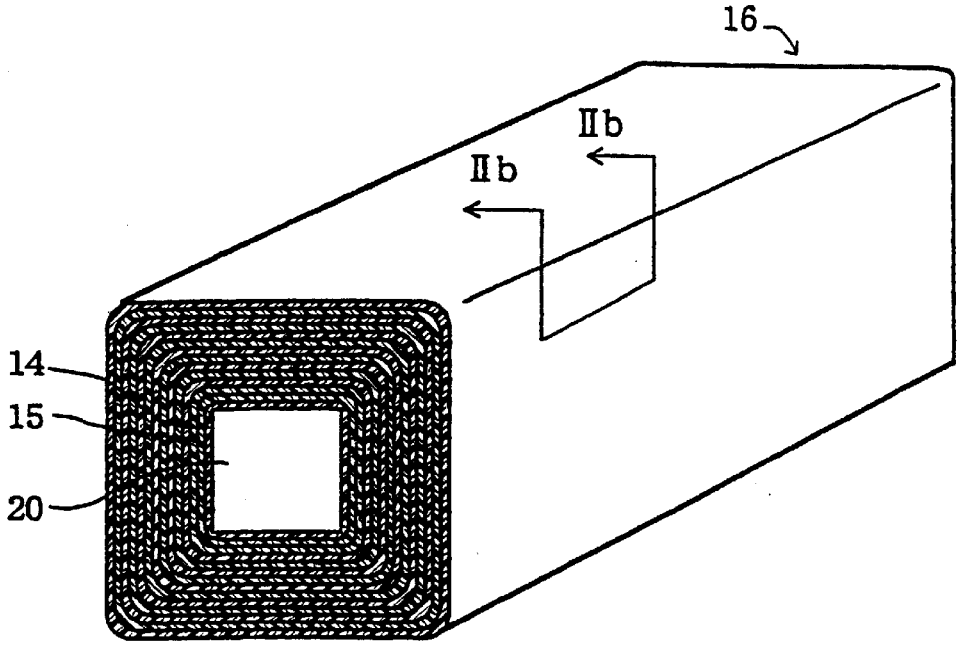
FIG. 2 shows a first embodiment of the laminate of a winding layer of insulated wires and an insulating resin film, which is obtained during the production of the anisotropic conductive film according to the present invention.
Figure 2B:
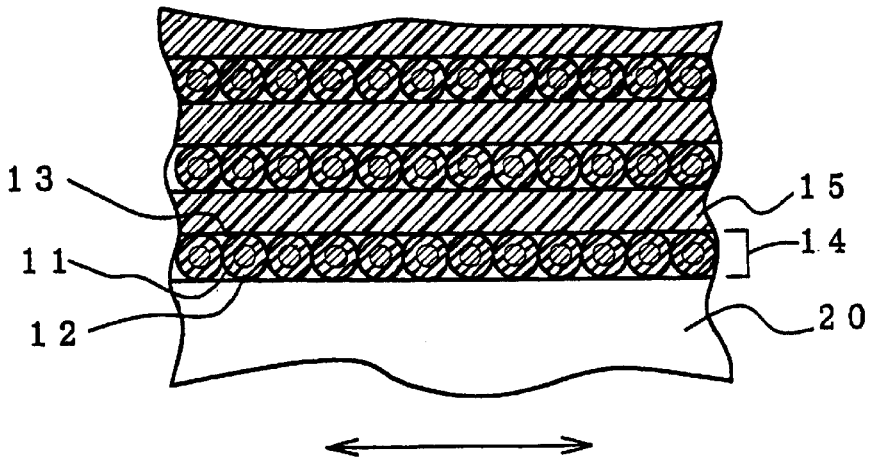
Figure 3:
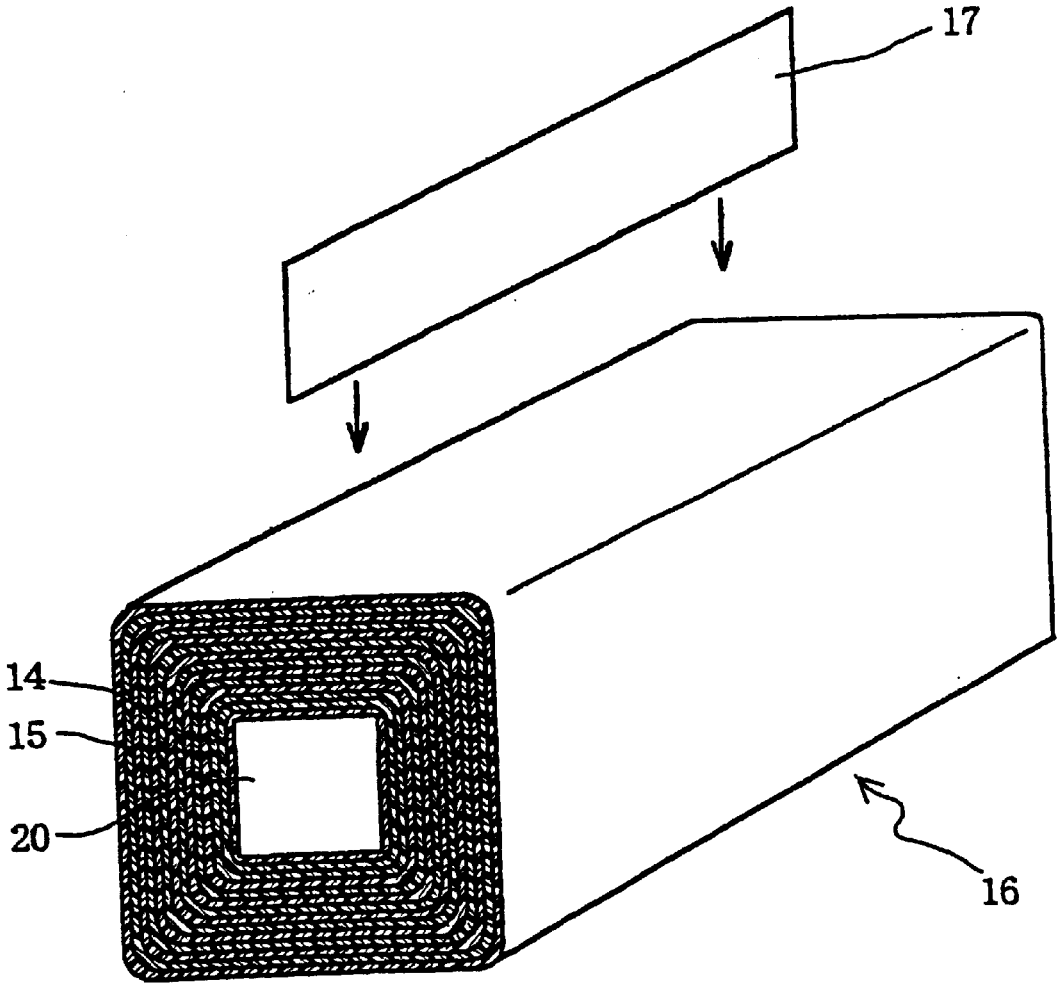
FIG. 3 shows cutting out of an anisotropic conductive film from the laminate shown in FIG. 2.

The production method of the anisotropic conductive film of the present invention is explained by referring to FIG. 1 to FIG. 3 showing a typical embodiment.

The production method of the anisotropic conductive film of the present invention comprises at least the following steps (a) to (c).

(a) An insulated wire 13 (FIG. 1(*a*)) comprising a metal conductor wire 11 and a coating layer 12 made from an insulating resin is wound around a core member 20 to form one roll layer as shown in FIG. 1(*b*) to give a winding layer 14 comprising a single row of insulated wires 13, and, as shown in FIG. 1(*c*), an insulating resin film 15 is layered on a part or the whole circumference (whole circumference shown in the Figure) of the winding layer 14. This step is repeated to give a laminate 16 comprising winding layers 14 comprising single rows of plural insulated wires and insulating resin films 15 alternately layered on each other, as shown in FIGS. 2(*a*), (*b*). FIG. 2(*a*) shows a whole perspective view of the laminate and FIG. 2(*b*) shows a section of FIG. 2(*a*) along the line IIb—IIb, or a partial section of the laminate in parallel to the longitudinal direction of the core member.

(b) The laminate 16 obtained in the above-mentioned (a) is heated or, heated and pressurized to melt at least one of coating layer 12 of the insulated wire 13 and an insulating resin film 15, and these are melted or meltpress-adhered to integrate winding layers 14 comprising a single row of insulated wires 13 and insulating resin films 15.

(c) As shown in FIG. 3, the laminate 16 obtained in the above-mentioned (b) and integrally comprising winding layers 14 comprising single rows of insulated wires 13 and insulating resin films 15 is sliced in a desired film thickness with a cutting tool (apparatus) 17 along the plane forming an angle with the insulated wire 13 to give an anisotropic conductive film.

Figure 4A:
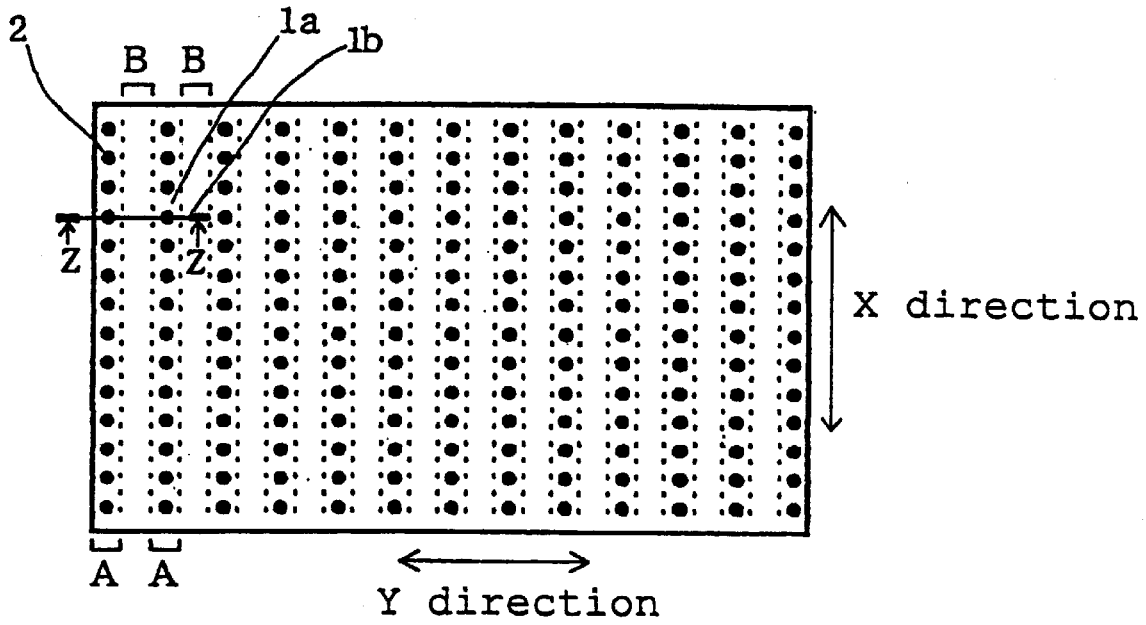
FIG. 4 is a plan view showing a first embodiment of the anisotropic conductive film of the present invention.
Figure 4B:
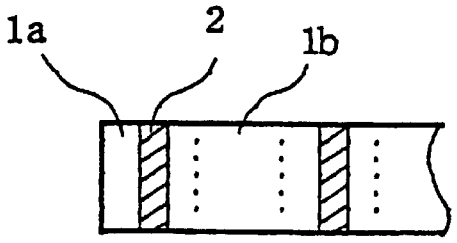

FIG. 4 schematically shows one embodiment of the anisotropic conductive film obtained by the production method of the present invention. FIG. 4(*a*) is a plan view of the anisotropic conductive film and FIG. 4(*b*) is an enlarged view of the section of FIG. 4(*a*) along the line Z—Z.

As shown in this Figure, the anisotropic conductive film of the present invention consists of band areas A and band areas B made from a second insulating resin layer 1*b* without conductive paths, wherein the band area A comprises a first insulating resin layer 1*a* and plural conductive paths 2 that are insulated from each other, arranged in one row in the first insulating resin layer 1*a* and penetrate the layer 1*a* in the thickness direction, and the areas A and B are alternately arranged (melt-adhered) to form a film, and the rows of conductive paths 2 disposed in the plural band areas A run in a parallel relationship.

The first insulating resin layer 1*a* of the band area A is formed by the coating layer 12 (see FIGS. 1, 2) of the insulated wire 13 to be wound around the core member 20 during production, and the width of the band area A is adjusted by the thickness of the coating layer 12 of the insulated wire 13. The second insulating resin layer 1*b* of the band area B is formed by the insulating resin film 15 (see FIGS. 1, 2) to be inserted in between the winding layers 14 of the insulated wires 13 during production, and the width of the band area B is adjusted by the thickness of the insulating resin film 15. Thus, the arrangement interval (arrangement interval in the X direction in the Figure) of the conductive paths 2 (metal conductor wires 11) that are arranged in one row in a first insulating resin layer 1*a* of the band area A is adjusted by the thickness of the coating layer 12 of the insulated wire 13 used for the production, and that in the arrangement direction (Y direction in the Figure: direction orthogonal with X direction) of band area A and the band area B, are adjusted by the thickness of the coating layer 12 of the insulated wire 13 used for the production, as well as the thickness of the insulating resin film 15.

The width of the above-mentioned band areas A, B and the arrangement interval of the conductive paths vary depending on the thermal fluidity of coating layer 12 of the insulated wire 13 and insulating resin film 15, the pressure for integrating the winding layer 14 of the insulated wire 13 and the insulating resin film 15 and the like. Therefore, the thickness of the coating layer 12 of the insulated wire 13 and the thickness of the insulating resin film 15 are set to achieve the desired width and interval, taking such variation factors into consideration.

With regard to the anisotropic conductive film obtained by the production method of the present invention, the arrangement interval (pitch) of the conductive paths 2 in the film in at least one direction (Y direction in FIG. 4) is adjusted as mentioned above according to the thickness of the coating layer 12 of the insulated wire 13 to be wound around a core member for the production, and the thickness of the insulating resin film 15 to be placed in between the winding layers 14 of the insulated wires 13. Thus, as compared to an anisotropic conductive film produced by a conventional method wherein the arrangement interval in any direction of the conductive paths 2 in the film is adjusted according to only the thickness of the coating layer of the insulated wire, the arrangement interval (pitch) of the conductive paths in the film can be widened, thereby reducing the density of the conductive paths in the film.

Figure 5:
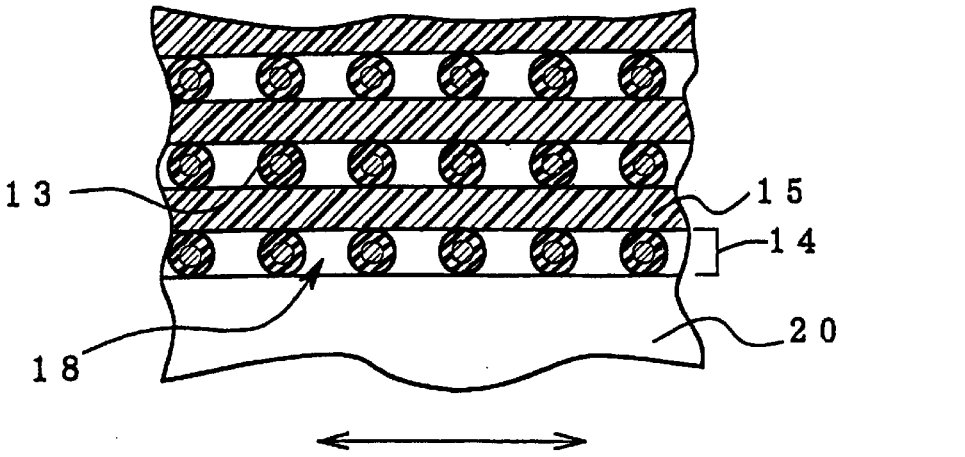
FIG. 5 shows a second embodiment of the laminate of a winding layer of insulated wires and an insulating resin film, which is obtained during the production of the anisotropic conductive film according to the present invention.
Figure 6:
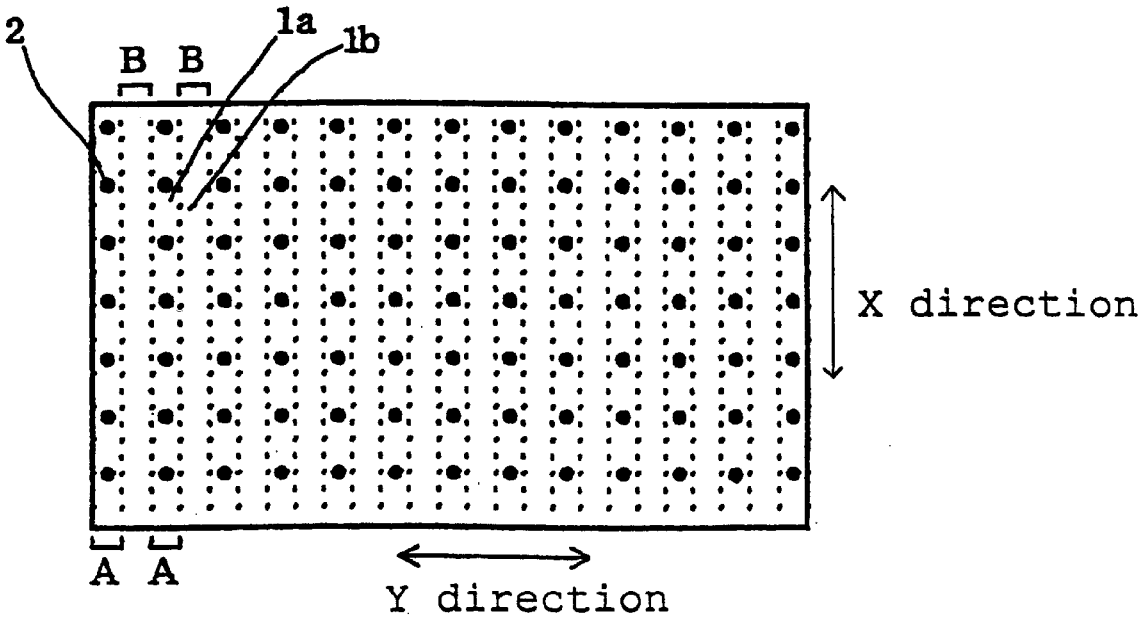
FIG. 6 is a plan view showing a second embodiment of the anisotropic conductive film of the present invention.

The anisotropic conductive film as shown in the above-mentioned FIG. 4 is produced by densely arranging the insulated wires 13 (without forming a space between insulated wires) in one row to form a winding layer 14 (see FIG. 1(*b*), FIG. 2(*b*)). As shown in FIG. 5, the insulated wires 13 may be arranged in one row while forming a space 18 between them to form a winding layer 14, in which case a resin from the insulating resin film 15 fills the space 18 between the insulated wires 13 in one layer of the winding layer 14 when the space cannot be filled with the resin alone of the coating layer 12 of the insulated wire 13 during the integration with the insulating resin film 15. FIG. 6 shows an anisotropic conductive film thus obtained. In this anisotropic conductive film, the interval (interval in the X direction in the Figure) of the conductive paths 2 arranged in one row in the band area A (first insulating resin layer 1*a*) is greater than that of the anisotropic conductive film of FIG. 4, and the density of the conductive paths in the film can be further reduced. While FIG. 6 shows a linear boundary between the band area A and the band area B, when a resin from the insulating resin film is used to fill the space between the insulated wires for the integration of the winding layer with the insulating resin film as mentioned above, the boundary between the band area A and band area B in fact generally becomes a curve like a wavy line.

Figure 7:
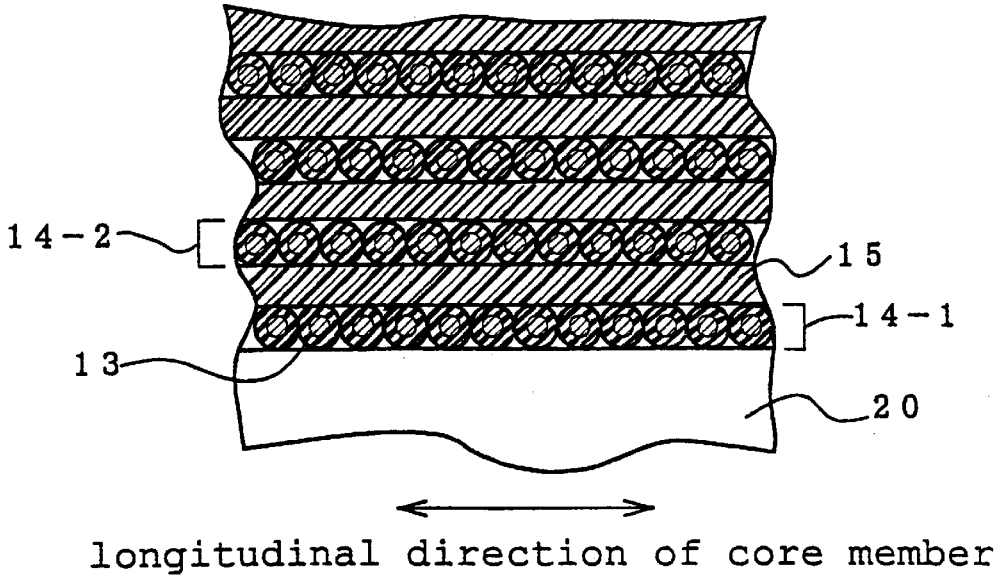
FIG. 7 shows a third embodiment of the laminate of a winding layer of insulated wires and an insulating resin film, which is obtained during the production of the anisotropic conductive film according to the present invention.
Figure 8:
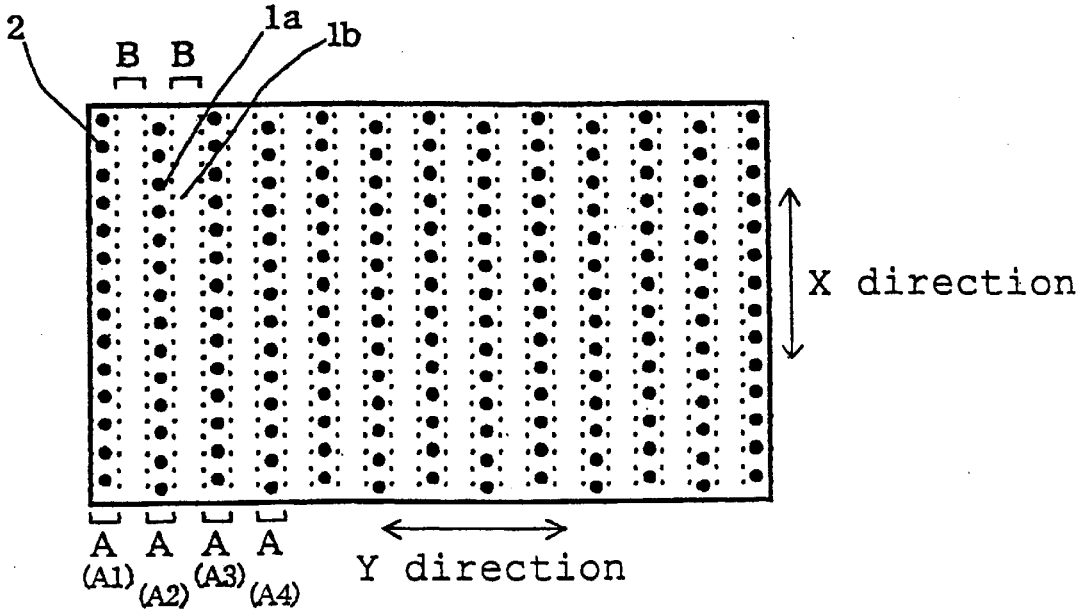
FIG. 8 is a plan view showing a third embodiment of the anisotropic conductive film of the present invention.

As shown in FIG. 7, moreover, the winding position of the insulated wires 13 in the odd-numbered winding layer 14-1 and that in the even-numbered winding layer 14-2 (where the central line of the insulated wire passes on the core member), as counted from the core member 20, are differently moved in the longitudinal direction of the core member (moved by generally half the winding interval (pitch)), as shown in FIG. 8. The conductive paths 2 in the two adjacent areas (A1 and A2) of the band area A in the obtained anisotropic conductive film do not correspond to each other, and the odd-numbered areas (A1 and A3) and the even-numbered areas (A2 and A4), as counted from one end of the film, have the corresponding conductive paths 2 (conductive paths 2 are arranged in closest packed state), widening the arrangement interval of the conductive paths 2 in the arrangement direction (Y direction in Figure) of the band area A and band area B. As a consequence, the density of the conductive paths 2 in the film can be decreased more than it is in the anisotropic conductive film of FIG. 4.

Figure 9:
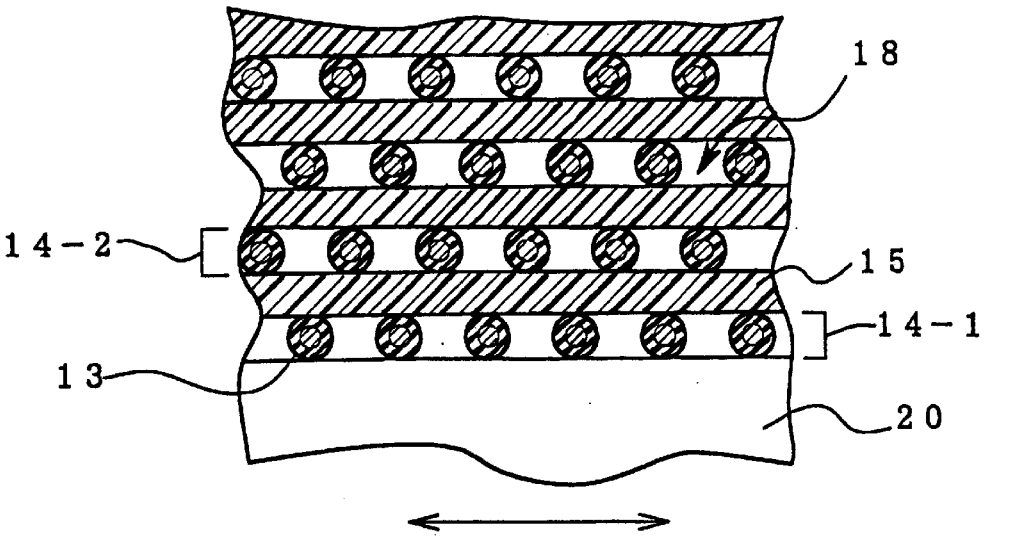
FIG. 9 shows a fourth embodiment of the laminate of a winding layer of insulated wires and an insulating resin film, which is obtained during the production of the anisotropic conductive film according to the present invention.
Figure 10:
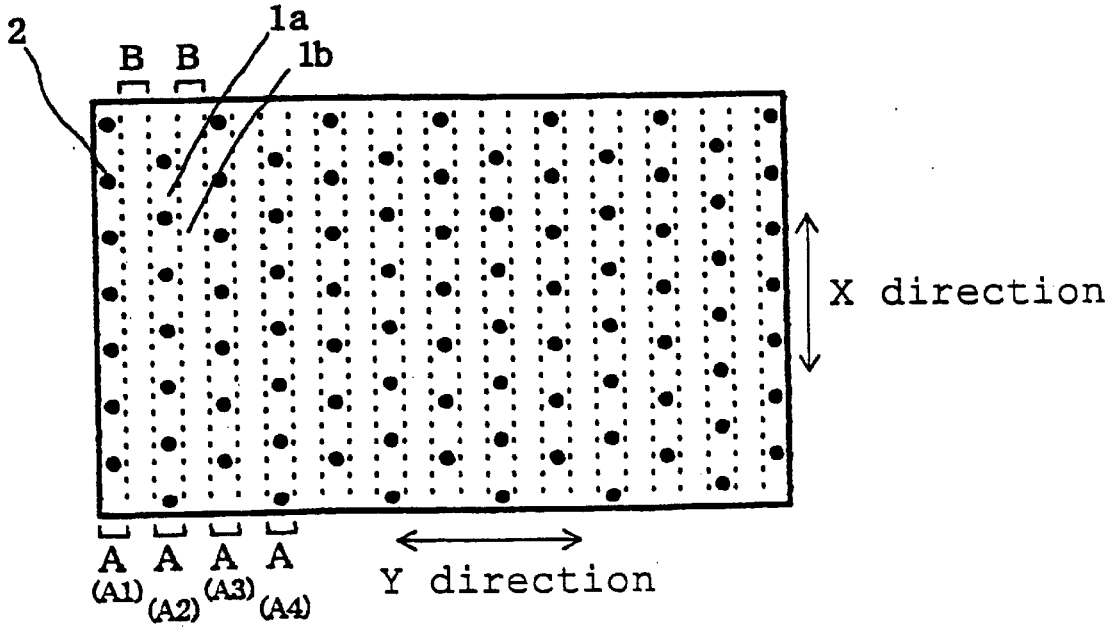
FIG. 10 is a plan view showing a fourth embodiment of the anisotropic conductive film of the present invention.

In addition, an embodiment combining the above-mentioned FIG. 5 and FIG. 7, wherein the insulated wires 13 are arranged in one row while placing a space 18 between them to form a winding layer, and the winding positions of the insulated wires 13 in the odd-numbered winding layers 14-1 and the even-numbered winding layers 14-2 are moved in the longitudinal direction of the core member, as shown in FIG. 9, and since the arrangement interval of the conductive paths 2 (interval in X direction in the Figure) arranged in one row in the band area A (first insulating resin layer 1*a*) and that of the conductive paths 2 in the arrangement direction (Y direction in the Figure) of the band areas A and B are widened, as shown in FIG. 10, the density of the conductive paths 2 in the film can be further decreased.

In the present invention, the metal conductor wire 11 (i.e., conductive path 2) constituting the insulated wire 13 can be preferably a metal wire made from at least one member selected from various known metal wires, such as gold, copper, aluminum, stainless, nickel and the like, from the aspect of electroconductivity. In addition, the sectional shape of the metal conductor wire 11 (conductive path 2) may be circular, polygonal or of other shape, which is generally circular. The wire diameter (outer diameter) of the metal conductor wire 11 (conductive path 2), in the case of a circular section, is generally 5–200 μm, preferably 10–80 μ. When it is polygonal or of other shape, the outer diameter is such that the diameter thereof affords the area within the above-mentioned range.

The wire diameter of the metal conductor wire 11 (conductive path 2) is preferably narrower in view of connection to a fine pitch electrode, but too fine a pitch degrades the handling property during winding. In addition, when the wire diameter is large, the resistance of the conductive path 2 can be advantageously reduced when the anisotropic conductive film is applied to a connection system where a high current flows, but too large a diameter may produce voids during integration of insulating resin film 15 and the winding layer 14 of the insulated wire. When the wire diameter of the metal conductor wire 11 falls within the above-mentioned range, the advantageous aspects as mentioned above are noticeably observed, suppressing disadvantageous aspects.

The coating layer 12 to cover the metal conductor wire 11 (first insulating resin layer 1*a* of band area A) may be made from a thermoplastic or thermosetting resin, such as polyimide resin, epoxy resin, polyetherimide resin, polyamide resin, phenoxy resin, acrylic resin, polycarbodiimide resin, fluorocarbon resin, polyester resin, polyurethane resin, polyamideimide resin and the like. This coating layer is preferably a thermoplastic resin that shows adhesive property by heating or by heating and pressurizing.

The thickness of this coating layer 12 is generally 0.5–20 μm, preferably 1–15 μm.

The insulated wire 13 can be wound around a core member 20 by a known technique for producing an electromagnetic coil, such as relay, transformer and the like. It is also possible to apply a spindle method including revolving the core member, a flyer method including circling of the wire or other method.

The insulating resin film 15 (i.e., second insulating resin layer 1*b* of band area B of anisotropic conductive film) may be any as long as it affords self-supporting property as a film, and it can adhere to the insulated wire 13 by heat melting. Examples thereof include a film made from a thermoplastic or thermosetting resin, such as polyimide resin, epoxy resin, polyetherimide resin, polyamide resin, phenoxy resin, acrylic resin, polycarbodiimide resin, fluorocarbon resin, polyester resin, polyurethane resin, polyamideimide resin and the like. This film may be made from a single resin or a mixture of two or more resins. Particularly, thermoplastic polyimide film, polycarbodiimide film, polyester resin film, thermosetting resin film containing an epoxy resin and the like are preferable. The same kind of resin as the coating layer 12 of insulated wire 13 is preferable, in view of the adhesive property between the two and the physical properties of the anisotropic conductive film.

This film may be made from a thermoplastic or a thermosetting resin according to a known method, such as casting method and the like, or may be a commercially available film.

While the film generally has a single-layer structure, it may have a multilayer structure when the anisotropic conductive film of the present invention is used for test purposes. When the film has a multilayer structure, a resin coating is generally formed on one surface or both surfaces of the film to be a substrate by coating and the like to afford a multilayer structure. When the film has a multilayer structure, the outermost layer of a resin coating of at least one layer on the side, which comes into contact with the insulated wire 13, is preferably made from a resin that melts and adheres at a temperature at which the substrate film does not soften. Particularly preferably, the outermost layer of a resin coating of at least one side of the multilayer structure film, which comes into contact with the insulated wire 13, is made from a resin having a softening point lower than the softening point of the substrate film by 20° C. or more. When the softening point of the outermost layer of a resin coating on one side or both sides, which comes into contact with the insulated wire, is the same as that of the substrate film or a temperature near this softening point, the fluidity control of the resin becomes difficult after heating the film to soften and flow, and integrating with insulated wire, and the pitch of the metal conductor wires (conductive paths) may become inconsistent, thereby unnecessarily making the pitch grow in some part.

As the substrate film, a resin film made from polyamide (nylon), polyester, polyimide, polyetherimide and the like, having resistance to heat of at least 100° C. (not softened at a temperature of not more than 100° C.), is preferable. The resin coating of the outermost layer of at least one side that comes into contact with insulated wire 13 is preferably made from a thermosetting epoxy resin composition.

As used herein, by the softening temperature is meant a temperature at which changes in the shrinkage reach the maximum, as determined by thermomechanical analysis (TMA) by measuring the displacement amount at 10° C./min with a load of 1 g/mm.

Figure 11:
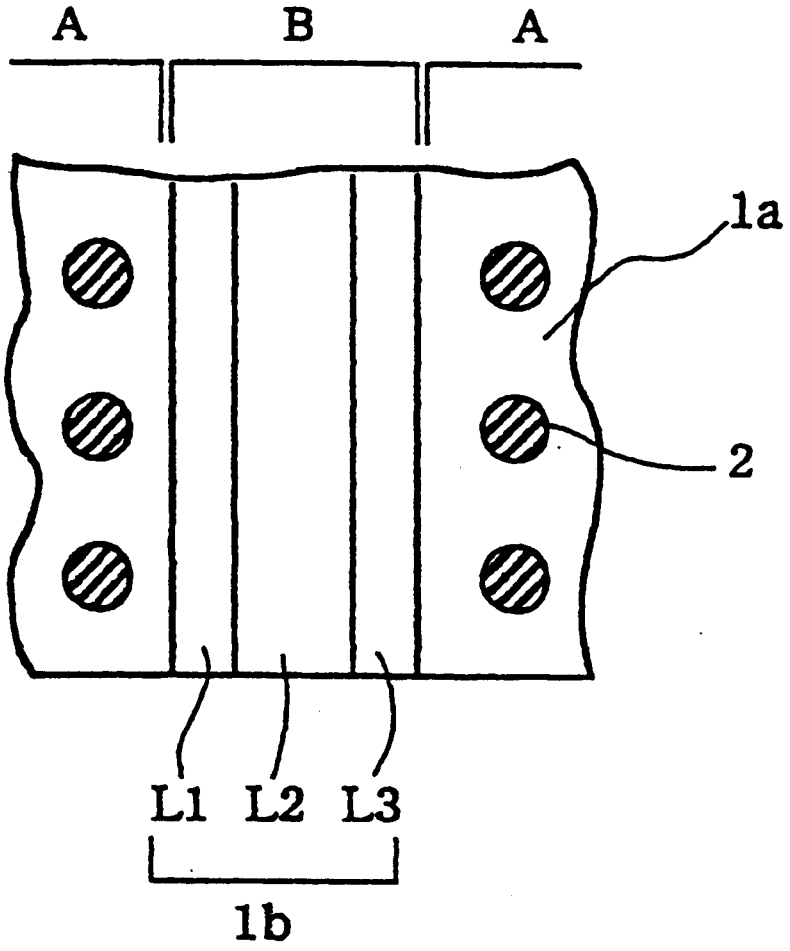
FIG. 11 shows a preferable band area B in the anisotropic conductive film of the present invention.

FIG. 11 shows an enlarged view of the boundary between the band area A and the band area B of the anisotropic conductive film produced using an insulating resin film 15 of the multilayer structure (3 layer structure). The second insulating resin layer 1*b* of the band area B has a multilayer structure comprising 3 layers (L1–L3) formed on top of another in the width direction. That is, the multilayer structure of the insulating resin film becomes a multilayer structure in the width direction of the second insulating resin layer 1*b* of the band area B.

The thickness of the insulating resin film 15 is generally about 10–1000 μm, preferably about 10 μm–500 μm.

The cutting tool (apparatus) 17 to slice the laminate 16, which is obtained by integrating the winding layer 14 of the insulated wire 13 and the insulating resin film 15, is not particularly limited and can be any as long as it can slice a metal conductor wire and the slicing object into films. For example, a wire saw, a dicer and the like can be used.

In the anisotropic conductive film of the present invention, the arrangement interval of the conductive paths 2 in the arrangement direction of the band area A and the band area B (interval in Y direction in FIGS. 4, 6, 8, 10), in other words, the distance between the centers of the conductive paths, varies depending on the diameter of the conductive path 2, but is generally 2.5–10 times, particularly preferably 2.5–8 times, the diameter of the conductive path.

Depending on the arrangement interval of conductive paths 2 arranged in one row in the band area A (interval in X direction in FIGS. 4, 6, 8, 10), the arrangement interval of the conductive paths 2 in the arrangement direction of the band area A and the band area B (interval in Y direction in FIGS. 4, 6, 8, 10) (distance between the centers of the conductive paths) is within the above-mentioned range. As a result, the volume ratio of conductive paths in the film can be reduced to 1–30%, preferably 5–25%, and the film can show superior deformability and increased resin content. Thus, the film can connect a conductive path 2 to a terminal of a test object with a low pressure, when used for testing connectors, and can adhere firmly to an object to be connected, when used as a mounting material The arrangement interval of the conductive paths 2 when closely packed in one row in the band area A (distance between the centers of the conductive paths 2) is generally 1.1–2.5 times, particularly preferably 1.5–2 times, the diameter of the conductive path.

When the insulated wires 13 are densely arranged in one row and wound at an interval of the conductive paths 2 (distance between the centers of conductive paths 2) in the band area A of preferably 1.1–2.5 times, particularly preferably 1.5–2 times, the diameter of the conductive path, a relatively hard anisotropic conductive film can be obtained (FIGS. 4 and 8). When the insulated wires 13 are arranged in one row forming a space and wound at an interval of the conductive paths 2 (distance between the centers of conductive paths 2) in the band area A of preferably 2.5–10 times, particularly preferably 2.5–8 times, the diameter of the conductive path, a relatively soft anisotropic conductive film can be obtained (FIGS. 6 and 10). In this way, anisotropic conductive films having a different hardness depending on the use of the film can be provided easily.

The arrangement state of the conductive paths 2 can be achieved by determining the diameter of the metal conductor wire 11 in the insulated wire 13, the thickness of the coating layer 12 and the thickness of the insulating resin film 15, adjusting the winding state of the winding layer 14 containing the insulated wires 13 (i.e., interval of insulated wires 13 in the winding layer 14 and winding positions of insulated wires 13 between winding layers 14 to be laminated), and heating the laminate 16 comprising winding layers 14 containing the insulated wires 13 and the insulating resin films 15, generally at 70–250° C., preferably 80–210° C., or, concurrently with the heating, pressurizing the laminate 16 at a pressure of generally 0.49–2.94 MPa, preferably 0.78–2.45 MPa, in consideration of the thermal properties (e.g., thermal fluidity etc.), adhesive property and the like of the coating layer 12 and the insulating resin film 15.

The anisotropic conductive film of the present invention has a thickness that is subject to change. It is generally 20–500 μm, preferably 50–200 μm.

The anisotropic conductive film of the present invention is prepared to have an elastic modulus of generally 0.01–6 GPa. When it is used for testing connectors, the film is preferably adjusted to have an elastic modulus of 0.01–2 GPa, preferably 0.01–1.5 GPa. An elastic modulus in this range makes the follow-up property to the irregularity, warp and the like of the object to be connected extremely fine, and the film can certainly connect a conductive path to a terminal (electrode) of a test object with a low pressure of about 9.8–294 mN (preferably 9.8–147 mN) per 1 terminal.

When it is used as a material for mounting, the film has an elastic modulus of 0.5–6 GPa, preferably 1–5 GPa. For use as a material for mounting, the coefficient of linear expansion is preferably made to be close to that of the chip to be connected. For this end, a filler such as silica and the like may be added to the resin. The addition of a filler generally results in an increased elastic modulus, but since the film has a small volume ratio of the conductive path, the elastic modulus does not increase to an unnecessary level but is set in a range suitable to not impair the workability mentioned above. In the connection interface, a decrease in the volume ratio of the conductive path increases the follow-up property to the object to be connected, and increases the adhesion area of the object to be connected. Thus, a highly reliable electrical connection can be formed.

The anisotropic conductive film of the present invention may be subjected to a post-treatment and the like for protruding the end of a conductive path from the film surface. Examples of such treatment include selective etching wherein the first insulating resin layer 1*a* and second insulating resin layer 1*b* (coating layer 12 of insulated wire 13, insulating resin film 15) are etched but the conductive path 2 (metal conductor wire 11 of insulated wire 13) is not, and the like. In this case, the amount of protrusion from the end of the conductive path 2 is generally 10–80 μm, preferably 10–50 μm.

The present invention is explained in more detail in the following by referring to Examples and Comparative Examples, which do not limit the present invention in any way.

EXAMPLE 1

A polyester (manufactured by Toray Industries, Inc., Hytrel (trademark), softening temperature 204° C.) was applied to a Cu thin wire (diameter 18 μm) in a thickness of 4 μm, and the wire was wound to form a single roll layer around a core member (section: 180 mm×180 mm square prism) without forming a space between wires. A 100 μm thick fluorocarbon/acrylic film (manufactured by Denki Kagaku Kogyo K.K., DENKA DX-14 (trademark), softening temperature 150° C., elastic modulus 1.3 GPa) was layered on the single roll layer. This process was repeated to give a laminate alternately comprising 50 layers of a winding layer comprising Cu thin wires having a coating layer made from a polyester resin in one row and a fluorocarbon/acrylic film layer. The Cu thin wire of the winding layer was wound while changing the winding position between the odd-numbered winding layers and the even-numbered winding layers in the longitudinal direction of the core member in a closest packing state. This laminate was heated and pressurized at 150° C., 1.96 MPa to give a block (polyester did not soften or flow, but only the fluorocarbon/acrylic film did). The core member was removed and this block was sliced with a wire saw along the plane forming an angle with the Cu thin wire to give a 100 μm thick anisotropic conductive film. During the production of this anisotropic conductive film, the arrangement interval of the conductive paths in the direction corresponding to the laminating direction of the winding layer containing Cu thin wires and the fluorocarbon/acrylic film (Y direction in FIG. 8) was 93 μm, which was about 5.2 times the diameter of the conductive path (Cu thin wire), and the arrangement interval of the conductive paths in the direction corresponding to the winding direction of the Cu thin wires of the winding layer (X direction in FIG. 8) was 80 μm, which was about 4.4 times the diameter of the conductive path (Cu thin wire). In addition, the volume ratio of the conductive paths in the film was 8%, and the film had an elastic modulus of 1.4 GPa.

This anisotropic conductive film was placed between a semiconductor element and a circuit board. A contact load was applied and the minimum load necessary for complete conduction of all the electrodes in the semiconductor element was measured. As a result, the contact load per electrode was 98 mN, and the electrode was free of deformation.

EXAMPLE 2

A polycarbodiimide resin (obtained by polymerizing 2,2-dimethyl-1,3-bis (4-aminophenoxy)propane (40 g), 3-methyl-1-phenyl-2-phospholene-1-oxide (1.14 g) and p-isopropylphenylisocyanate (2.19 g) in toluene at 80° C. for 2 hr, softening temperature 100° C.) was applied to a Cu thin wire (diameter 18 μm) in a thickness of 7.5 μm, and the wire was wound around the same core prism as used in Example 1 to form a single roll layer without forming a space between the wires. A 50 μm thick thermosetting epoxy film (softening temperature 100° C., elastic modulus 2 GPa) was applied on the single roll layer, which process was repeated to give a laminate alternately comprising 100 layers of a winding layer comprising Cu thin wires having a coating layer made from a polycarbodiimide resin in one row and an epoxy film layer. The thermosetting epoxy film used here was obtained by reacting a bisphenol A type epoxy resin with an acid anhydride hardener and a carboxyl group-containing liquid rubber for a predetermined time to make the resin in a B-stage, and forming the B-stage resin into a film (specifically, Epikote 827 (trademark, 100 g) manufactured by Yuka Shell Epoxy Kabushiki Kaisha, methylhexahydrophthalic anhydride (144 g) and CTBN modified epoxy resin (100 g, manufactured by TOTO KASEI CO., LTD., YR450 (trademark) were reacted at 50° C. for 5 hr). The Cu thin wire of the winding layer was wound while changing the winding position between the odd-numbered winding layers and the even-numbered winding layers in the longitudinal direction of the core member in a closest packing state. This laminate was heated and pressurized at 160° C., 1.96 MPa to give a block (both polycarbodiimide resin and thermosetting epoxy resin film softened and flew). The core member was removed and this block was sliced with a wire saw along the plane forming an angle with the Cu thin wire to give a 50 μm thick anisotropic conductive film. During the production of this anisotropic conductive film, the arrangement interval of the conductive paths in the direction corresponding to the laminating direction of the winding layer containing Cu thin wires and the epoxy film (Y direction in FIG. 8) was 76 μm, which was about 4.2 times the diameter of the conductive path (Cu thin wire), and the arrangement interval of the conductive paths in the direction corresponding to the winding direction of the Cu thin wire of the winding layer (X direction in FIG. 8) was 33 μm, which was about 1.8 times the diameter of the conductive path (Cu thin wire). In addition, the volume ratio of the conductive paths in the film was 10%, and the film had an elastic modulus of 1 GPa.

This anisotropic conductive film was placed between a 3 mm□ Si chip and FR-4 board (a glass epoxy board for printed wiring board as defined in National Electrical Manufacturers Association (NEMA)) to adhere them, and a shearing adhesion was measured to find to be 15 MPa. Further, a semiconductor element and a circuit board were connected using this anisotropic conductive film. This film was subjected to a TCT test (−55° C. to 125° C.). As a result, the film maintained the initial resistance value up to 1000 cycles.

EXAMPLE 3

An amideimide resin (softening temperature 170° C.) was applied to a Cu thin wire (diameter 18 μm) in a thickness of 3μm, and the wire was wound around the same core member as used in Example 1 to form a single roll layer at a 48 μm interval. A 150 μm thick polycarbodiimide resin film (softening temperature 100° C.) was applied on the single roll layer, which process was repeated to give a laminate alternately comprising 100 layers of a winding layer comprising Cu thin wires having a coating layer made from an amideimide resin in one row and a polycarbodiimide resin film. All the Cu thin wire in the winding layers were wound such that the winding position of each Cu thin wire comes to the same position in the longitudinal direction of the core member. This laminate was made into a block under the conditions of 140 ° C., 1.96 MPa (polycarbodiimide resin alone softened and flew). The core member was removed and this block was sliced with a wire saw along the plane forming an angle with the Cu thin wire to give a 70 μm thick anisotropic conductive film. During the production of this anisotropic conductive film, the arrangement interval of the conductive paths in the direction corresponding to the laminating direction of the winding layer containing Cu thin wires and the polycarbodiimide film (Y direction in FIG. 6) was 141 μm, which was about 7.8 times the diameter of the conductive path (Cu thin wire), and the arrangement interval of the conductive paths in the direction corresponding to the winding direction of the Cu thin wires of the winding layer (X direction in FIG. 6) was 80 μm, which was about 4.4 times the diameter of the conductive path (Cu thin wire). The film had a density of the conductive paths of 6%, and an elastic modulus of 3 GPa.

This film was placed between a 3 mm□ Si chip and FR-4 board to adhere them, and a shearing adhesion was measured to find to be 20 MPa. Further, a semiconductor element and a circuit board were connected using this anisotropic conductive film. This film was subjected to a TCT test (−55° C. to 125° C.). As a result, the film maintained the initial resistance value up to 1000 cycles.

COMPARATIVE EXAMPLE 1

In the same manner as in Example 1 except that a nylon film was not inserted between winding layers, an anisotropic conductive film was prepared. During the production of this anisotropic conductive film, the arrangement interval of the conductive paths in the direction corresponding to the laminating direction of the winding layer containing Cu thin wires was 23 μm, which was about 1.3 times the diameter of the conductive path (Cu thin wire), and the arrangement interval of the conductive paths in the direction corresponding to the winding direction of the Cu thin wires was 23 μm, which was about 1.3 times the diameter of the conductive path (Cu thin wire).

This anisotropic conductive film was placed between a semiconductor element and a circuit board to connect them. A contact load was applied and the minimum load necessary for complete conduction of all the electrodes in the semiconductor element was measured. As a result, the contact load per electrode was 588 mN, and the electrode was greatly deformed.

COMPARATIVE EXAMPLE 2

In the same manner as in Example 2 except that an epoxy resin film was not inserted between winding layers, an anisotropic conductive film was prepared. During the production of this anisotropic conductive film, the arrangement interval of the conductive paths in the direction corresponding to the laminating direction of the winding layer containing Cu thin wires was 29 μm, which was about 1.6 times the diameter of the conductive path (Cu thin wire), and the arrangement interval of the conductive paths in the direction corresponding to the winding direction of the Cu thin wires was 29 μm, which was about 1.6 times the diameter of the conductive path (Cu thin wire). This film was placed between a 3 mm□Si chip and FR-4 board to adhere them, and a shearing adhesion was measured to find to be 5 MPa. Further, a semiconductor element and a circuit board were connected using this anisotropic conductive film. This film was subjected to a TCT test (−55° C. to 125° C.). As a result, the film maintained the initial resistance value only up to 300 cycles.

As is evident from the foregoing explanation, the present invention enables production of an anisotropic conductive film having a sufficiently widened arrangement interval of conductive paths at a low cost without forming unnecessary voids in the film.

The anisotropic conductive film of the present invention has a sufficient strength and deformability, shows fine follow-up property to an object to be connected, is capable of connecting a conductive path to a terminal (electrode) of a test object with a low pressure, when used for testing connectors, and can form a highly reliable electrical connection by firmly adhering to an object to be connected, when used as a mounting material.

This application is based on application No. 2000-117039 filed in Japan, the contents of which are incorporated hereinto by reference.

What is claimed is:

1. An anisotropic conductive film which comprises plural band areas A, each band area A comprising a first insulating resin layer and plural conductive paths, the conductive paths being insulated from each other, arranged in one row and penetrating the first insulating resin layer in a layer thickness direction, and plural band areas B, each band area B comprising a second insulating resin layer without a conductive path, wherein the band areas A and the band areas B are alternatively melt-adhered to form the film, and wherein the plural band areas A each comprise a row of conductive paths, the rows of the conductive paths being arranged in parallel, and two band areas A sandwiching one band area B are disposed at a distance of 2.5–10 times the diameter of the conductive path as measured between the centers of the conductive paths of two band areas A.

2. The anisotropic conductive film of claim 1, wherein the first insulating resin layer of the band area A and the second insulating resin layer of the band area B are made from the same kind of resin.

3. The anisotropic conductive film of claim 1, wherein the second insulating resin layer of the band area B has a multilayer structure comprising plural layers laminated in the width direction thereof, wherein at least one layer on the side that comes into contact with the side surface of the first insulating resin layer of the band area A softens and flows to be able to adhere to the first insulating resin layer at a temperature at which the layers other than this layer do not soften.

4. The anisotropic conductive film of claim 3, wherein, of the plural layers constituting the second insulating resin layer of the band area B, at least one layer on the side that comes into contact with the side surface of the first insulating resin layer of the band area A has a softening point lower by 20° C. or more than that of the layers other than the surface layer.

5. The anisotropic conductive film of claim 1, wherein the film comprises conductive paths in a volume proportion of 1–30%.

* * * * *